US006955492B1

(12) United States Patent
Huang

(10) Patent No.: US 6,955,492 B1
(45) Date of Patent: Oct. 18, 2005

(54) STRUCTURE FOR AN APPLICATION TIP OF A MEDIUM CONTAINER FOR USE IN PAINTING WITH SUCH A MEDIUM

(76) Inventor: Tao-Chen Huang, No. 30, Lane 120, Chang Lu Rd., Chang Hua City (TW)

( * ) Notice: Subject to any disclaimer, the term of this patent is extended or adjusted under 35 U.S.C. 154(b) by 312 days.

(21) Appl. No.: 10/307,566

(22) Filed: Dec. 2, 2002

(51) Int. Cl.[7] ..... B43K 1/06; A47L 13/30; B65D 25/40

(52) U.S. Cl. ..... 401/265; 401/261; 222/567; 222/569

(58) Field of Search ..... 401/266, 265, 401/261, 183–186; 222/566, 567, 569, 570, 222/573

(56) References Cited

U.S. PATENT DOCUMENTS 2,762,539 A * 9/1956 Nyden ..... 222/569

2,834,521 A * 5/1958 Nyden ..... 222/569

* cited by examiner

*Primary Examiner*—David J. Walczak
(74) *Attorney, Agent, or Firm*—Alan D. Kamrath; Nikolai & Mersereau, P.A.

(57) ABSTRACT

A medium applicator includes a medium container, a cap provided with a neck, and an application tip fastened detachably to the neck of the cap. The application tip is provided with a conical portion, a fastening portion opposite to the conical portion, and a shoulder located between the conical portion and the fastening portion. The neck is provided with a longitudinal through hole in communication with the medium container. The longitudinal through hole is provided in the inner wall with a rest portion on which the shoulder of the application tip is rested at the time when the fastening portion of the application tip is fitted securely into the neck, thereby preventing the application tip from being forced into the cap by an external force.

2 Claims, 11 Drawing Sheets

STRUCTURE FOR AN APPLICATION TIP OF A MEDIUM CONTAINER FOR USE IN PAINTING WITH SUCH A MEDIUM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an applicator structure for use in the art of painting designs or compositions on a surface, such as the skin of a human body.

BACKGROUND OF THE INVENTION

The conventional medium applicator, such as a nail polisher, comprises a container for holding a medium which is a liquid mixed with pigment for use as a paint, and an application tip which is of a pointed construction and is fastened with one end of the container. The pointed application tip is vulnerable to impact and is therefore prone to being forced by such impact back into the container. The sharp end of the application tip can easily inflict an injury on a person. In addition, the passage of the application tip is clogged easily. Moreover, the conventional application tip is not versatile.

BRIEF SUMMARY OF THE INVENTION

The primary objective of the present invention is to provide a medium applicator with an application tip which is versatile and is free from the deficiencies of the conventional application tip described above.

The application tip structure of the present invention comprises a cap and an application tip. The cap is provided in the interior with a longitudinal through hole and is fastened at an inner end thereof with one end of a medium container such that the longitudinal through hole is in communication with the interior of the medium container. The longitudinal through hole of the cap is provided in the inner wall of an outer end thereof with a rest portion. The application tip has a conical outer end, an inner end, and a shoulder located between the outer end and the inner end. The application tip is joined with the cap such that the inner end of the application tip is received in the longitudinal through hole of the cap, and that the shoulder of the application tip is rested on the rest portion of the outer end of the through hole of the cap. The medium container serves as a handle of the applicator.

The features and the advantages of the present invention will be more readily understood upon a thoughtful deliberation of the following detailed description of the preferred embodiments of the present invention with reference to the accompanying drawings.

DETAILED DESCRIPTION OF THE INVENTION

Figure 1:
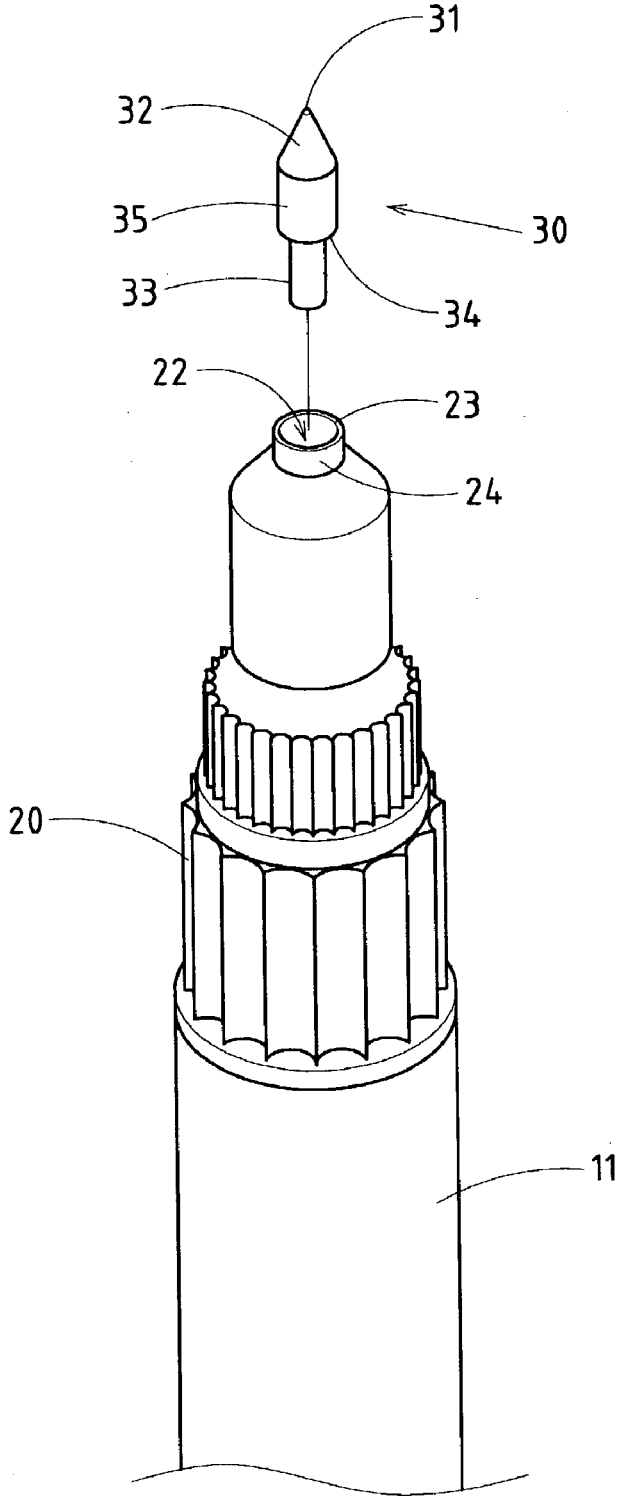
FIG. 1 shows a partial exploded perspective view of a first preferred embodiment of the present invention.

As shown in FIGS. 1–4, a medium applicator embodied in the present invention is used in the art of painting. The medium is a liquid that is mixed with pigment for use as a paint. The medium application comprises a medium container 11, a cap 20, and an application tip 30.

The medium container 11 is elastic and is provided at one end with an outer threaded portion 12.

The cap 20 is fastened with the outer threaded portion 12 of the medium container 11 such that an absorbent rod 21 is dipped into the medium contained in the hollow interior of the medium container 11. The cap 20 is provided in the interior with a longitudinal through hole 22, which is in turn provided in the inner wall of one end of a neck 24 with a rest portion 23.

The application tip 30 is provided at one end with a conical portion 32, and at other end with a fastening portion 33. Located between the conical portion 32 and the fastening portion 33 is a shoulder 34. The conical portion 32 is provided with a discharge aperture 31 through which the medium is let out. The application tip 30 is joined with the cap 20 such that the fastening portion 33 of the application tip 30 is received in the longitudinal through hole 22 of the cap 20, and that the shoulder 34 of the application tip 30 is rested on the rest portion 23 of the longitudinal through hole 22 of the cap 20, thereby preventing the application tip 30 from being forced into the cap 20 by an external force.

Figure 5:
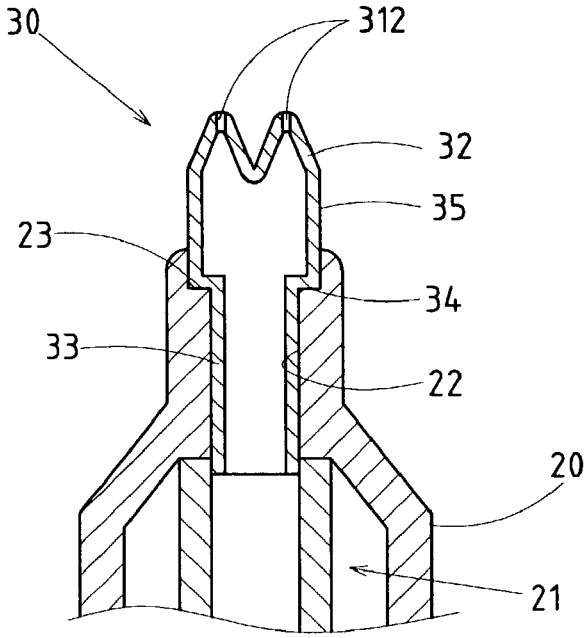
FIG. 5 shows a longitudinal sectional view of the application tip and the cap of a second preferred embodiment of the present invention.
Figure 6:
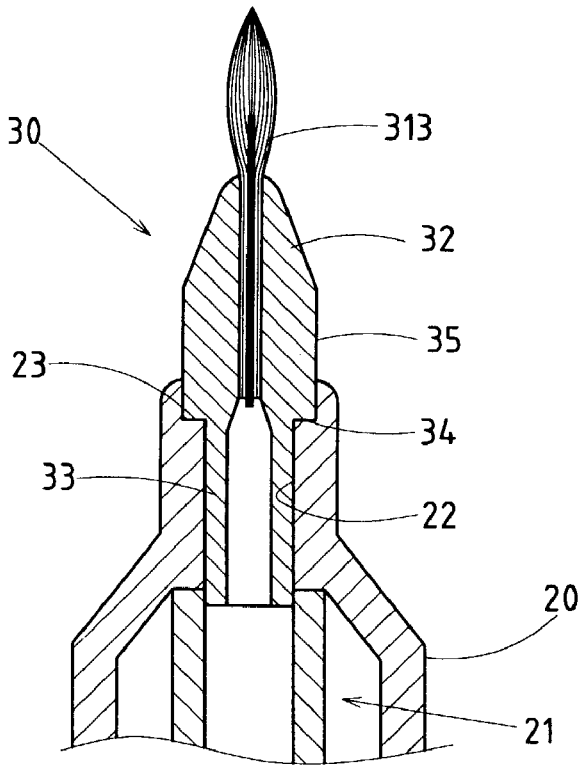
FIG. 6 shows a longitudinal sectional view of the application tip and the cap of a third preferred embodiment of the present invention.
Figure 7:
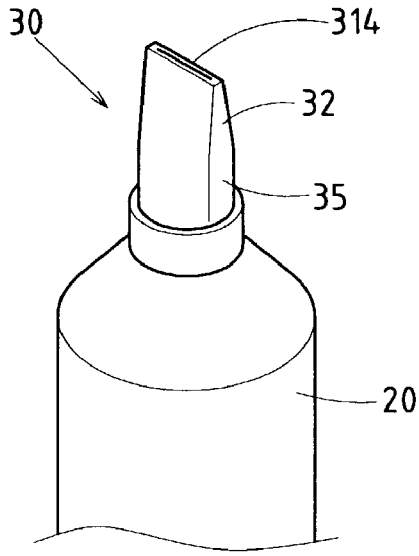
FIG. 7 shows a perspective view of a fourth preferred embodiment of the present invention.

The conical portion 32 of the application tip 30 may be provided with two discharge apertures 312, as shown in FIG. 5, a brush 313 as shown in FIG. 6, or an elongated hole 314 as shown in FIG. 7.

Figure 8:
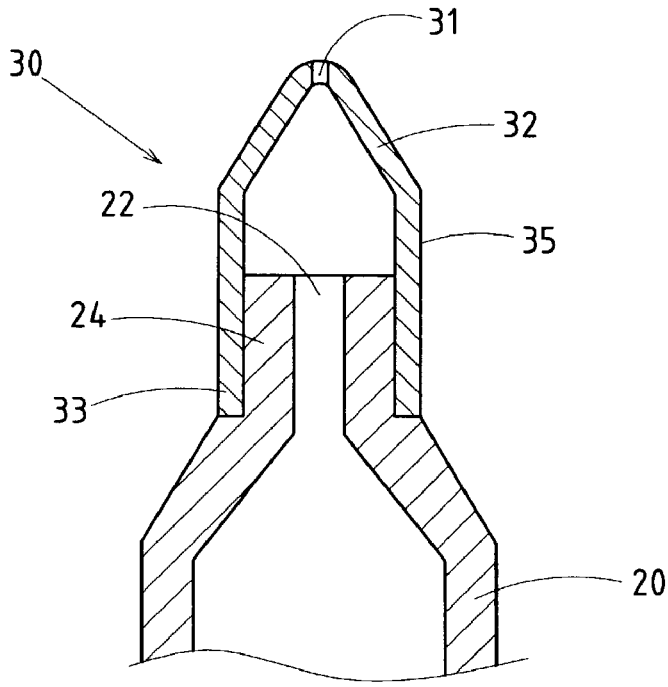
FIG. 8 shows a longitudinal sectional view of the application tip and the cap of a fifth preferred embodiment of the present invention.

As shown in FIG. 8, the fastening portion 33 of the application tip 30 is fitted over the neck 24 of the cap 20.

Figure 9:
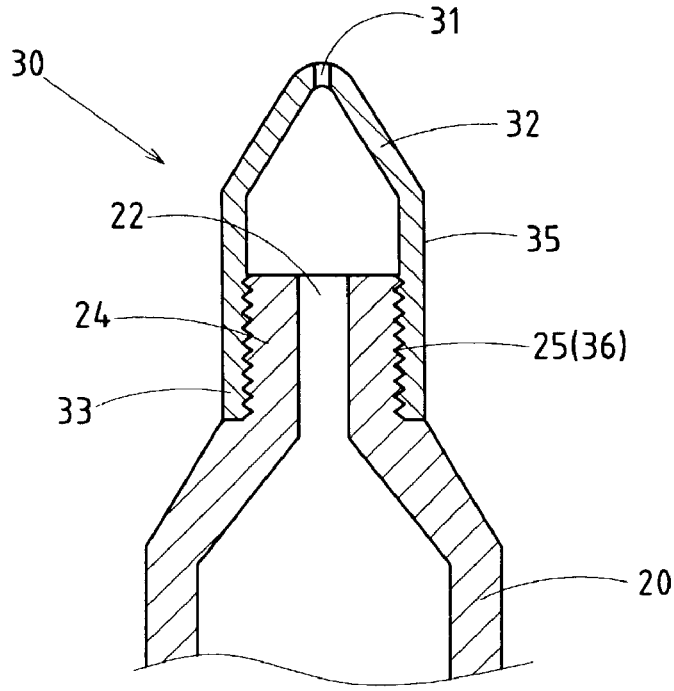
FIG. 9 shows a longitudinal sectional view of the application tip and the cap of a sixth preferred embodiment of the present invention.

As shown in FIG. 9, the fastening portion 33 of the application tip 30 is provided with an inner threaded portion 36, while the neck 24 of the cap 20 is provided with an outer threaded portion 25. The application tip 30 is fastened with the cap 20 such that the inner threaded portion 36 of the fastening portion 33 of the application tip 30 is engaged with the outer threaded portion 25 of the neck 24 of the cap 20.

Figure 10:
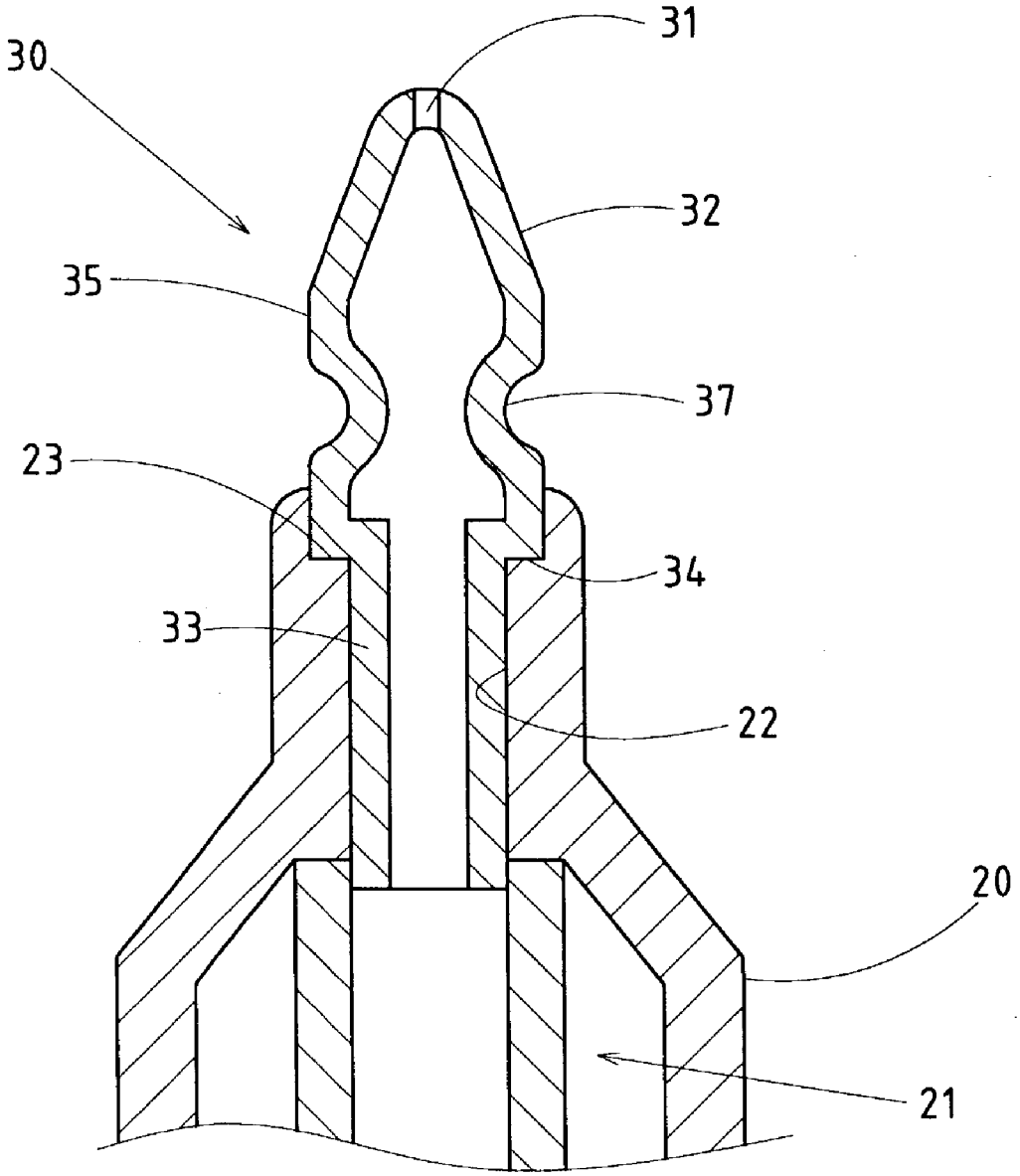
FIG. 10 shows a longitudinal sectional view of the application tip and the cap of a seventh preferred embodiment of the present invention.
Figure 11:
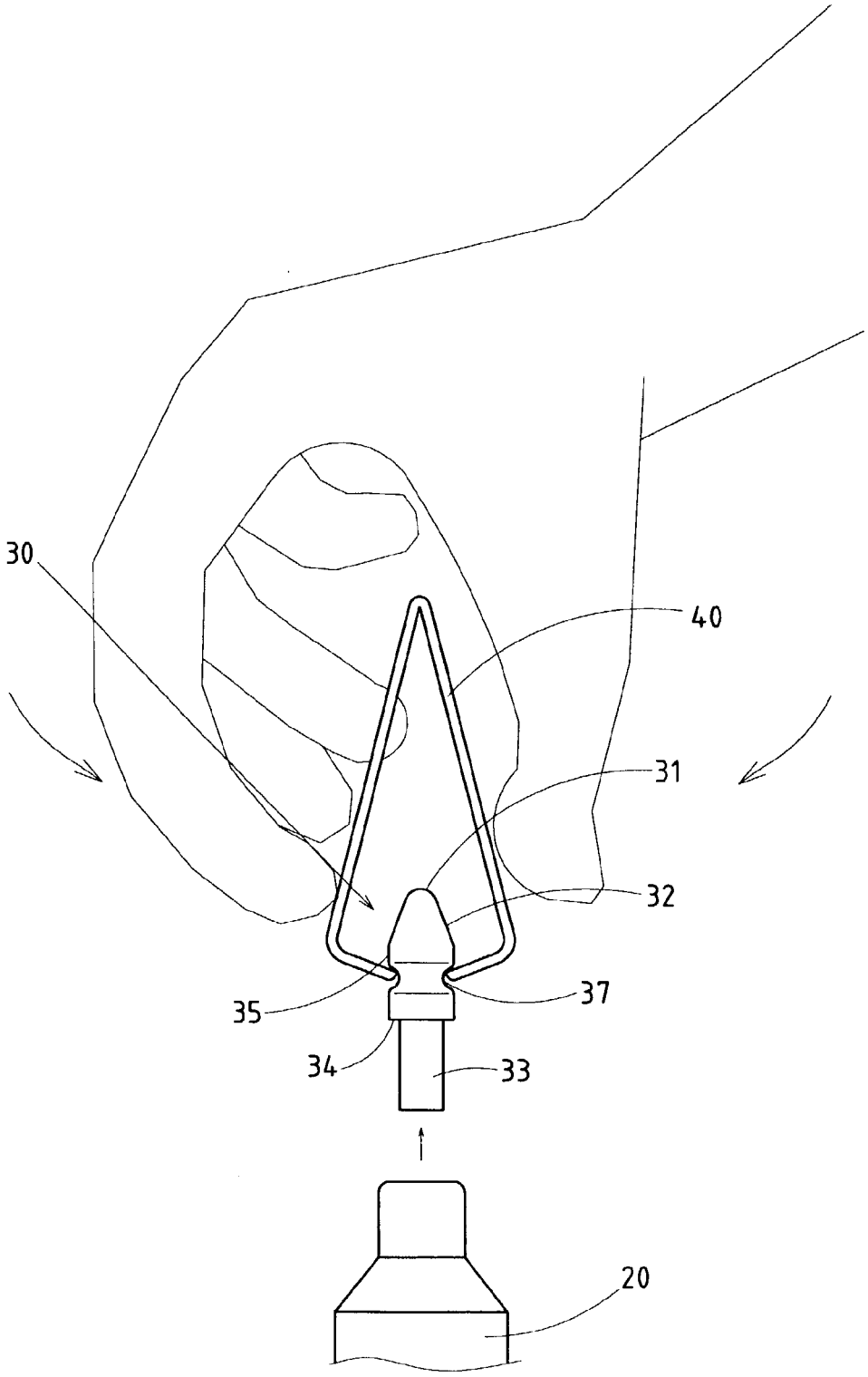
FIG. 11 shows a schematic view of the separating of the application tip from the cap of the seventh preferred embodiment of the present invention as shown in FIG. 10.

As shown in FIG. 1, the application tip 30 is provided with a grip portion 35 which is located between the conical portion 32 and the fastening portion 33. The grip portion 35 is held by fingers at the time when the application tip 30 is held with hand. The grip portion 35 is provided in the outer wall with a groove 37, as shown in FIG. 10. The groove 37 is used to locate the tips of a gripping device 40 by means of which the application tip 30 is removed from the cap 20, as shown in FIG. 11.

Figure 12:
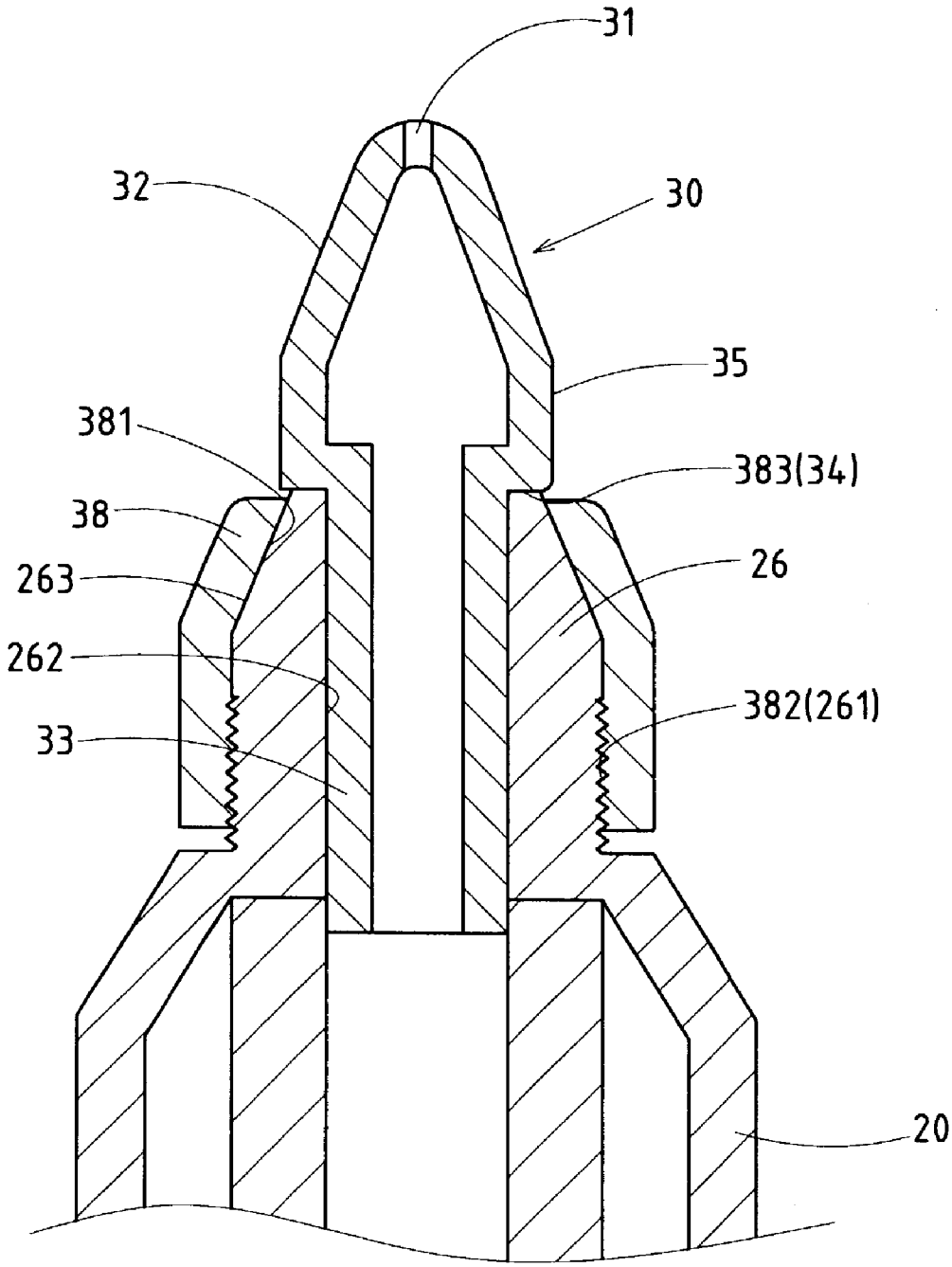
FIG. 12 shows a longitudinal sectional view of the application tip and the cap of an eighth preferred embodiment of the present invention.
Figure 13:
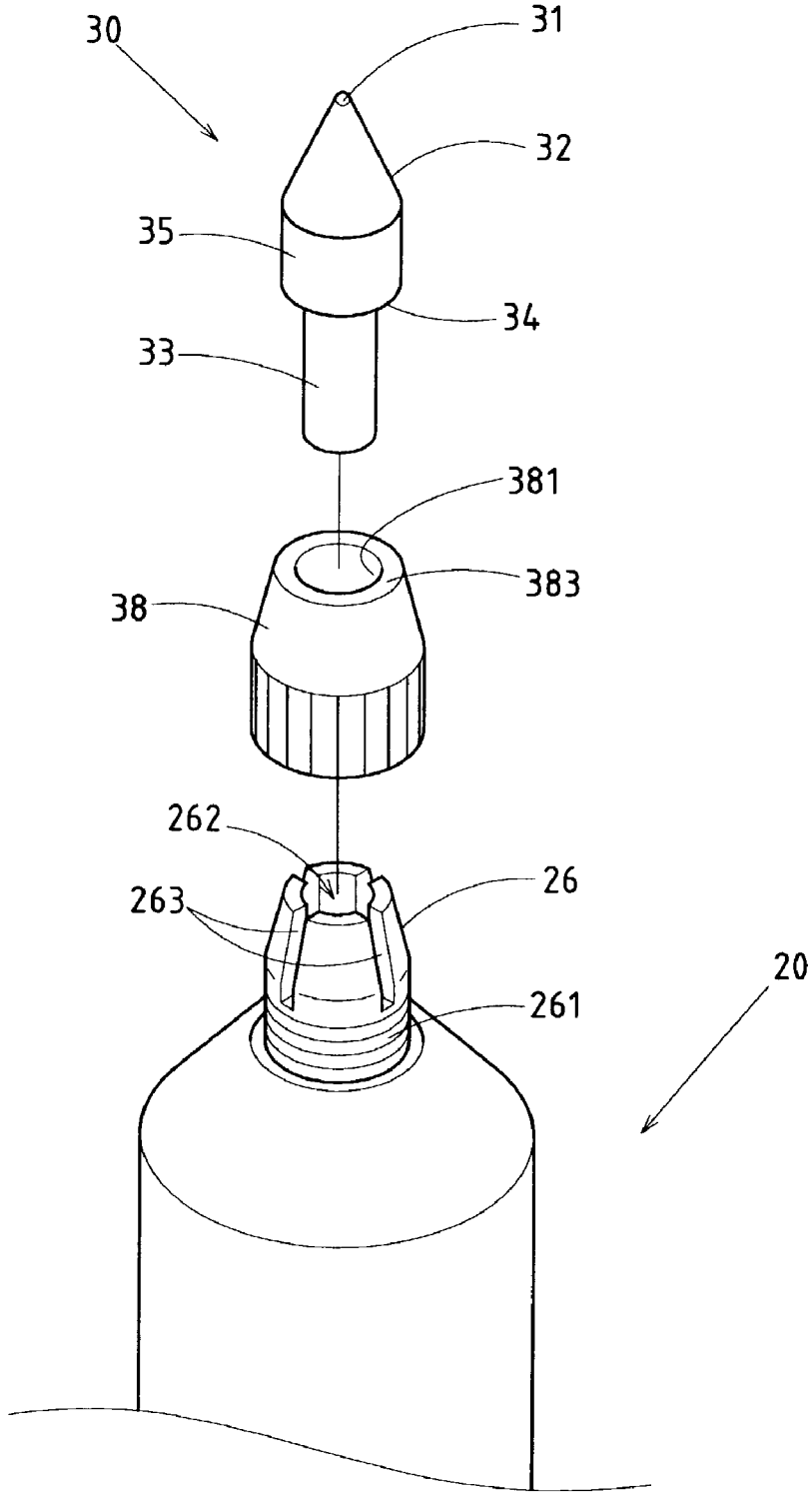
FIG. 13 shows an exploded perspective view of the eighth preferred embodiment as shown in FIG. 12.

As shown in FIGS. 12 and 13, the cap 20 is provided with a tapered neck 26 which is provided at the base thereof with an outer threaded portion 261. The tapered neck 26 is further provided with a longitudinal through hole 262, and a plurality of contractible wall pieces 263 extending from the base and circumventing the longitudinal through hole 262. The neck 26 is provided with a tapered locating body 38 fitted there over. The locating body 38 is provided with a tapered through hole 381 which is provided in the inner wall of the bottom end thereof with an inner threaded portion 382, as shown in FIG. 12. The tapered through hole 381 is provided in the rim of the top end thereof with a rest portion 383. The locating body 38 is fitted over the neck 26 such that the inner threaded portion 382 of the locating body 38 is engaged with the outer threaded portion 261 of the neck 26, and that the contractible wall pieces 263 of the neck 26 are received in the tapered through hole 381. The application tip 30 is fastened with the neck 26 of the cap 20 in such a manner that the fastening portion 33 of the application tip 30 is located in the longitudinal through hole 262 of the neck 26, and that the fastening portion 33 is firmly embraced by the contractible wall pieces 263 of the neck 26 and that the shoulder 34 of the application tip is stopped by the rest portion 383 of the top end of the tapered through hole 381 of the locating body 38, as shown in FIG. 12.

Figure 2:
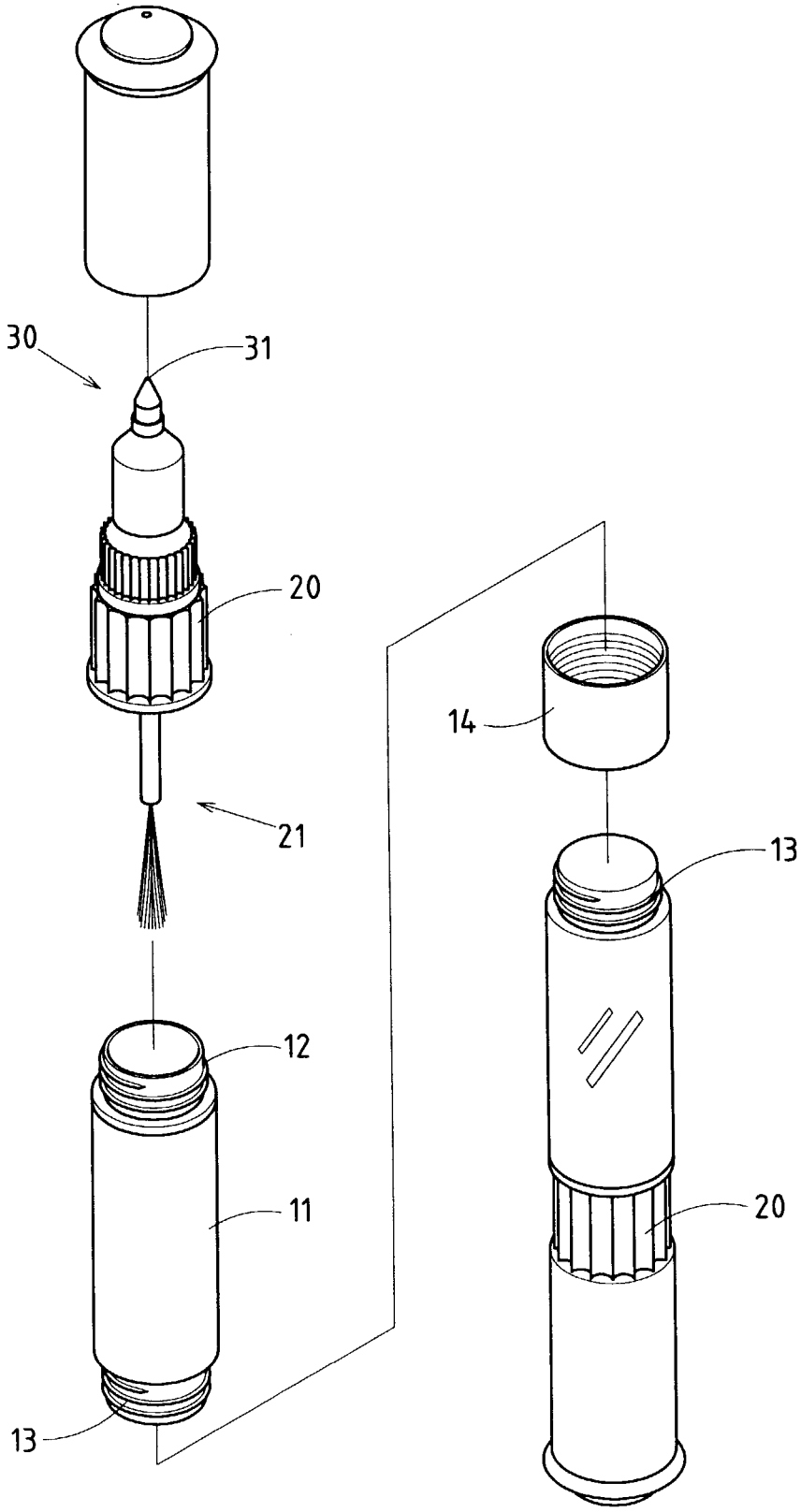
FIG. 2 shows another partial exploded perspective view of the first preferred embodiment of the present invention.
Figure 3:
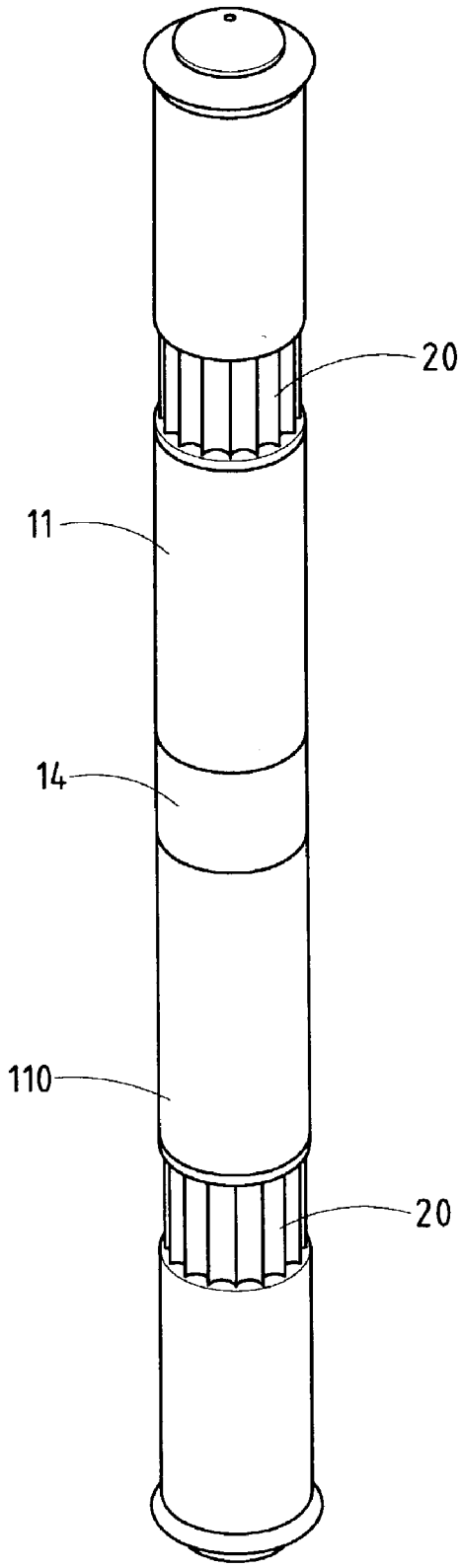
FIG. 3 shows a perspective view of the first preferred embodiment of the present invention.
Figure 4:
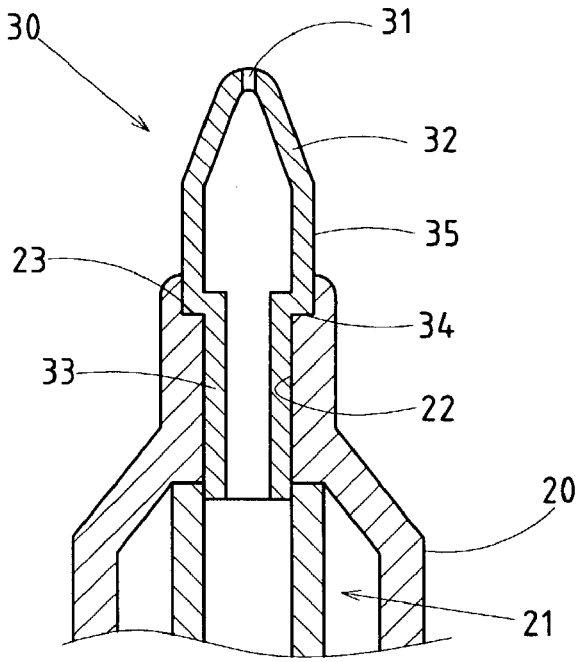
FIG. 4 shows a longitudinal sectional view of the application tip and the cap of the first preferred embodiment of the present invention.
Figure 14:
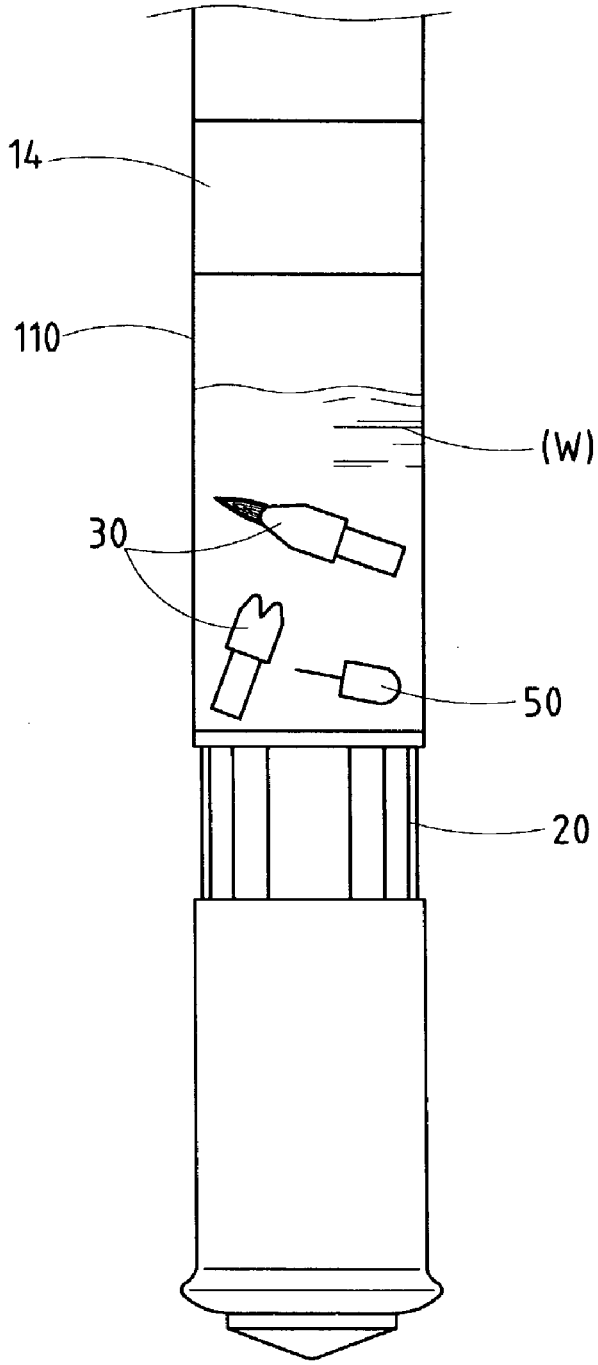
FIG. 14 shows a schematic view of a ninth preferred embodiment of the present invention.

As shown in FIGS. 2 and 3, the medium container 11 is provided at other end with an outer threaded portion 13 by means of which the medium container 11 is fastened with one end of another container 110 in conjunction with a fastening ring 14. The second container 110 may be used to hold a cleansing agent "W", as shown in FIG. 14, for the purpose of purging the application tips 30 and a device 50 which is used for unclogging the discharge aperture 31 of the application tip 30.

The embodiments of the present invention described above are to be regarded in all respects as being illustrative and nonrestrictive. Accordingly, the present invention may be embodied in other specific form without deviating from the spirit thereof The present invention is therefore to be limited only by the scopes of the following claims.

I claim:

1. A medium applicator, comprising:

a medium container a cap having a first end mounted on said medium container and a second end provided with a cylindrical neck;

said cap having an inner wall formed with a longitudinal through hole having a top end extending through said neck;

said neck of said cap having an inner wall provided with an annular rest portion;

an application tip mounted on said neck of said cap and having a first end provided with a cylindrical fastening portion fitted into and located in said neck of said cap, a second end provided with a conical portion and a mediate portion provided with a cylindrical grip portion located between said fastening portion and said conical portion;

said conical portion of said application tip having a distal end formed with a discharge aperture in communication with an inside of said application tip and said longitudinal through hole of said cap;

said application tip having an annular shoulder located between said fastening portion and said grip portion and stopped by said rest portion of said neck of said cap.

2. The medium applicator as claimed in claim 1, wherein said grip portion of said application tip has an outer wall formed with an annular groove.

* * * * *